United States Patent [19]

McCaslin

[11] 4,338,547

[45] Jul. 6, 1982

[54] APPARATUS AND METHOD FOR GENERATING LIGHT DESIGNS

[76] Inventor: Robert E. McCaslin, 1227 Coldwater Canyon, Beverly Hills, Calif. 90210

[21] Appl. No.: 160,875

[22] Filed: Jun. 19, 1980

[51] Int. Cl.[3] ..... H05B 37/02

[52] U.S. Cl. ..... 315/312; 315/210; 315/323; 362/35; 362/800; 362/806

[58] Field of Search ..... 315/200 A, 312, 323, 315/210; 362/35, 287, 800, 806, 811; 40/432; 84/464 R; 340/755, 148

[56] References Cited

U.S. PATENT DOCUMENTS

| | | | |
|---|---|---|---|
| 1,043,981 | 11/1912 | Strong | 340/755 X |
| 4,161,018 | 7/1979 | Briggs et al. | 362/811 X |
| 4,264,845 | 4/1981 | Bednarz | 315/323 |

OTHER PUBLICATIONS

*Audio Display,* Electronics Today International, vol. 8, No. 8, Aug. 1979, pp. 87–91.

*Primary Examiner*—Eugene R. La Roche
*Attorney, Agent, or Firm*—John L. McGannon

[57] ABSTRACT

Apparatus and method for generating light designs using a plurality of light emitting diodes on the outer, flat surface of a motor-driven rotor which is rotatably mounted on a base. The diodes are coupled through sliding contacts on the shaft of the rotor to control circuitry carried by the base. The circuitry includes a switching network having a signal input fed by one or more oscillators. The switching network includes comparators for the diodes to compare the voltage of the input signals from the oscillators with a characteristic voltage for each diode, respectively. The diodes are turned on when the input signal voltages have predetermined values with respect to the characteristic voltages, so that diodes can be operated in a sequence and at frequencies to provide distinctive, repeatable designs as the diodes rotate with the rotor. Resistive and capacitive components can be used to change the waveform of the input signals to the switching network. A speaker can be driven from the output of the oscillators to provide sounds corresponding to the design patterns formed by the diodes. The switching network may be provided with a control to cause the diodes to form illuminated dots or bars as the diodes rotate with the rotor.

21 Claims, 6 Drawing Figures

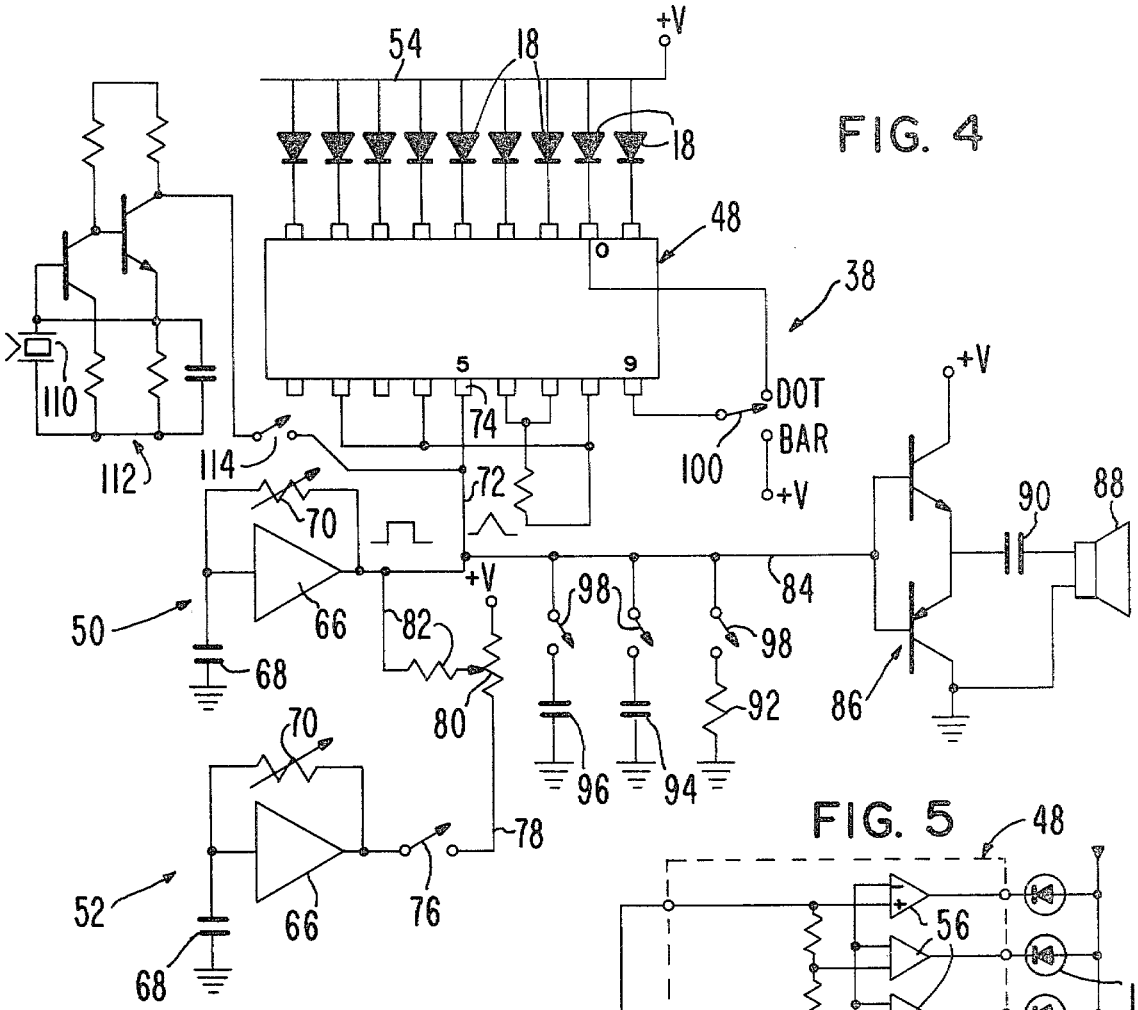
FIG. 4
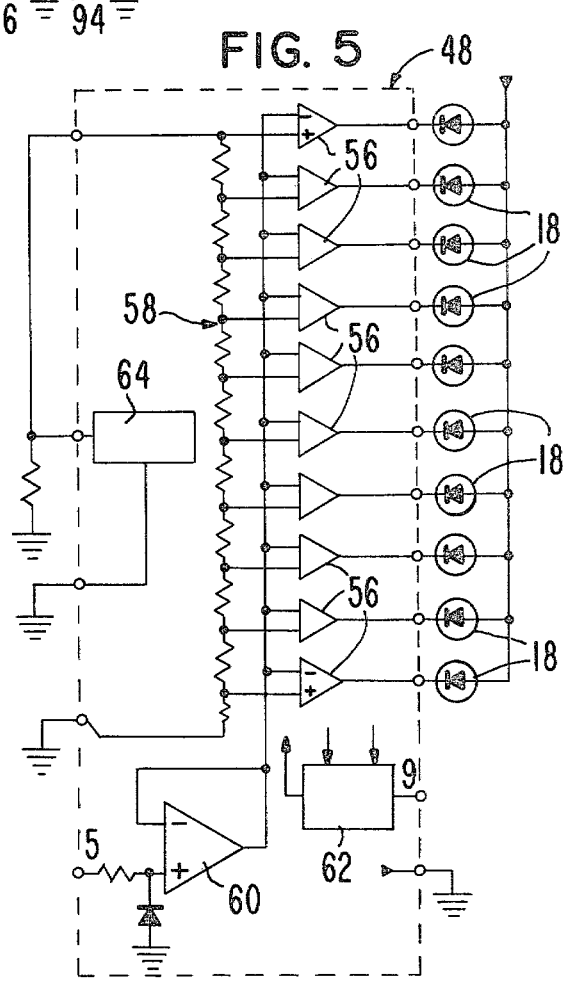
FIG. 5
FIG. 6
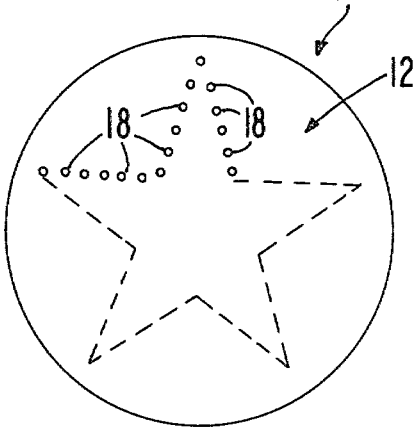

APPARATUS AND METHOD FOR GENERATING LIGHT DESIGNS

This invention relates to improvements in lighting techniques in which distintive light designs are generated and, more particularly, to apparatus and a method for forming light designs with light emitting diodes.

BACKGROUND OF THE INVENTION

Techniques of using a plurality of light sources for providing distintive light patterns in space have been known in the past. U.S. Pat. No. 1,043,981 shows a light design apparatus comprises of a plurality of incandescent bulbs mounted on one face of a flat, rotatable disk coupled to a drive motor. Also, light emitting diodes have been used as light sources in devices which provide spatial light patterns. U.S. Pat. No. 3,737,722 discloses the use of a single light emitting diode at the outer end of a resilient rod which is hand-held and moved about in space to cause the spatial light patterns when the light emitting diode is flashed on and off. U.S. Pat. No. 4,161,018 discloses the use of a number of light emitting diodes in various forms of ornamental devices, such as jewelry and the like. Other patents disclosing light emitting diodes which flash on and off to provide light patterns include U.S. Pat. Nos. 3,737,731, 3,986,144 and 3,984,674.

While the foregoing patents suggest the sequential operation of a number of light sources and, in particular, light emitting diodes, they describe circuits which are generally complex and which limit the choices of light patterns formed by the light sources to a relative few. Thus, none of such patents discloses or suggests structure which is capable of providing many different light patterns with relatively few controls and with relatively simple circuitry. Because of this drawback in the prior disclosures, a need has arisen for improvements in the way light designs of many different patterns and shapes can be achieved.

BACKGROUND OF THE INVENTION

The present invention satisfies the aforesaid need by providing apparatus and a method for generating light designs wherein the apparatus of the invention, including the electronic circuitry forming part of the invention, is simple in construction, is capable of forming a wide variety of light patterns in space, and can be used without any special skills on the part of the user. To this end, the invention comprises a plurality of light emitting diodes mounted for movement along continuous paths with the paths being adjacent to each other. The diodes are coupled through suitable sliding contact structure to control circuitry by means of which each diode is provided with a characteristic voltage different from that of the other diodes. The apparatus further includes a signal generator for applying input signals to the circuitry wherein the waveforms and frequencies of the input signals and the speed of movement of the diodes determines the light designs formed by the diodes.

The signal generating means can be of any suitable construction. Typically, such means includes one or a pair of oscillators, one of the oscillators being operable by itself or with the other oscillator. In either case, the waveform of the output signals of the oscillators can be varied to provide variations in the light patterns produced by the diodes. Also, waveform shaping means can be provided with the signal generating means to provide a specific input signal, such as a sawtooth wave to achieve other distinctive light patterns and designs.

The control circuitry includes a switching network which can be simplified by the use of a plurality of comparators, one comparator for each diode, respectively, the circuitry further including a resistance string to provide a characteristic operating voltage for each diode, respectively. As the input signals are applied to the diodes, the diodes operate in a sequence determined by comparing the voltages of the input signals to the characteristic voltages of the diodes. The comparator means can also provide a control of the operation of the light emitting diode so that, as the diodes are moved along their paths, the light emitted from the diodes will be in the form of dots or in the form of bars depending upon which is desired.

The primary object of this invention is to provide apparatus and a method for providing distinctive light designs using light emitting diodes wherein the diodes are movable along respective paths and are coupled to control circuitry in a manner such that each diode has a characteristic operating voltage different from that of other diodes so that the diodes will be turned on and off as the voltages of input signals applied to the control circuitry are compared to the characteristic voltages so as to permit many different light patterns depending upon the waveforms and frequencies of the input signals.

Other objects of the present invention will become apparent as the following specification progresses, reference being had to the accompanying drawings for an illustration of the invention.

IN THE DRAWINGS

FIG. 4 is a schematic diagram of the control circuit, for operating the light emitting diodes;

FIG. 5 is a schematic diagram of a switching unit forming a part of the control circuit; and FIG. 6 is a schematic view of the rotor and light emitting diodes, showing the way the diodes can be operated to provide a light design in the form of a star.

Figure 2:
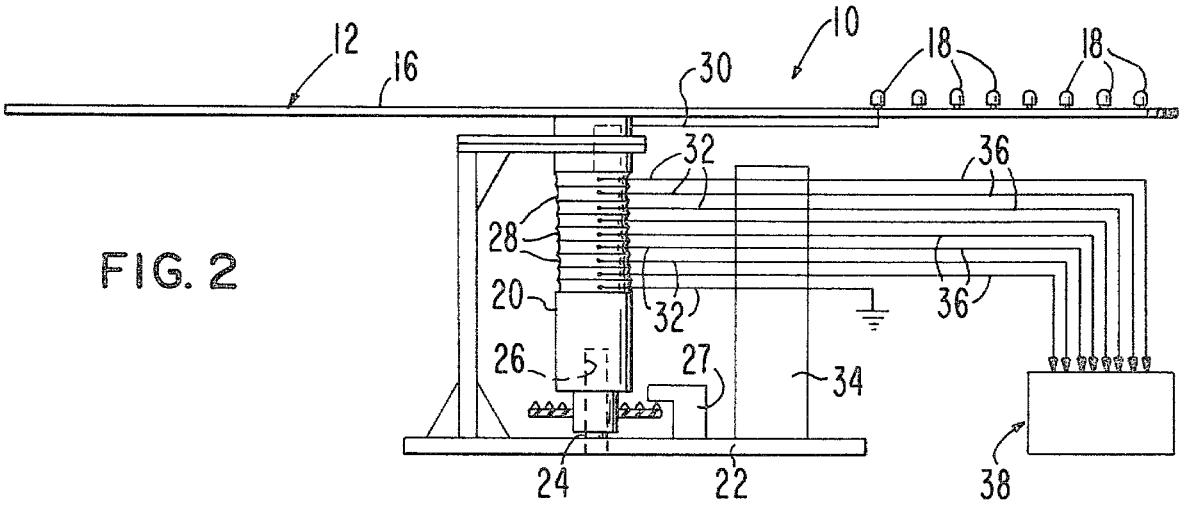
FIG. 2 is a fragmentary, side elevational view, partly schematic, of the apparatus showing the light emitting diodes, the rotor, and rotary contact means for coupling a control circuit to the light emitting diodes.

The light design apparatus of the present invention is broadly denoted by the numeral 10 and includes a rotor 12 mounted on a base 14 for rotation about a central axis. The rotor has a generally flat upper surface 16 and carries a plurality of light emitting diodes 18 arranged in a generally radial fashion along a radial line extending from the central axis of the rotor to a location near the outer periphery of the rotor. The light emitting diodes project outwardly from the flat surface 16 of the rotor and the two leads of each diode support the diodes so that its main body portion is generally in the same plane as the main body portions of the other diodes. Thus, as shown in FIG. 2, the diodes are generally in a plane parallel with the plane of flat outer surface 16 of rotor 12. For purposes of illustration, there are eight diodes uniformly spaced apart on the rotor with the innermost diode spaced slightly outwardly from the central axis of the rotor and with the outermost diode spaced slightly inwardly from the outer periphery of the rotor. The envelopes of the diodes may be of different colors or may be of the same color, whichever is desired.

Rotor 12 has a shift 20 secured thereto and concentric to the central axis of the rotor. The shaft is mounted on a platform 22 forming part of base 14 for rotation about the central axis of the rotor. Rotor 12 can be secured to platform in any suitable manner for purposes of illustration, the platform has a central pin 24 extending laterally therefrom, and the inner end of the shaft 20 has a bore 26 for receiving the pin so that the shaft can rotate on the pin itself. A motor 27 is coupled to shaft 20 for rotating the rotor about its central axis.

Shaft 20 has a plurality of metallic, electrically conducting bands 28 which surround the shaft and make electrical contact with respective diodes 18. Thus, each band is electrically connected by a conductor, such as a conductor 30 shown in dashed lines in FIG. 2, to a respective diode 18. One of the bands 28 is common to all of the diodes, such common band typically being coupled to a voltage source.

To provide electrical contact means for bands 28, a plurality of resilient, metallic strips 32 are provided on a generally rigid, electrically non-conducting member 34 secured to and extending laterally from platform 22 as shown in FIG. 2. The outer ends of strips 32 are in sliding engagement with respective bands 28 so that the bands can rotate with shaft 20 while making electrical contact with respective strips 32. The strips are coupled with respective leads 36 which extend outwardly from member 34 to control circuitry 38 hereinafter described with respect to FIG. 4. Such circuitry controls the operation of light emitting diodes 18 and the circuitry, with different input signals applied thereto, permits the diodes to provide different light designs by way of variations in the waveforms and frequencies of the input signals.

Figure 1:
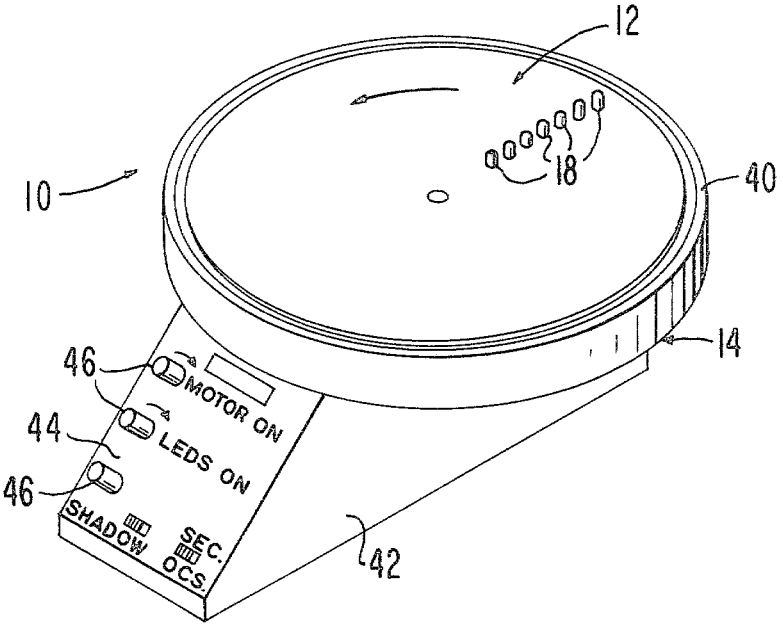
FIG. 1 is a perspective view of the light design apparatus of the present invention, showing a group of light emitting diodes mounted for rotation on a rotor carried by the base of the apparatus.

Base 14 as shown in FIG. 1 includes a circular rim 40 coupled in any suitable manner to platform 22 and generally surrounding rotor 12. The rim can be mounted on a flat, generally horizontal surface or can be mounted on an inclined surface or on a vertical wall. Thus, apparatus 10 can be used in any one of a number of different orientations. Rim 40 has a lateral extension 42 provided with a control panel 44 having manual controls, such as knobs, switches or the like, for controlling the speed of rotation of rotor 12 as well as for controlling signal generating means forming part of circuitry 38.

Circuitry 38 is shown in more detail in FIG. 4 and includes a switching network 48 and signal generating means including a first oscillator 50 and a second oscillator 52. The light emitting diodes 18 are coupled to the output terminals of switching network 48 and are coupled also to a common lead 54 which is adapted to be connected to a voltage source which can be a battery carried by base 14.

Any suitable switching network 48 can be used. A preferred switching network is one identified as LM3914 Dot/Bar Display Driver made and sold by National Semiconductor Corporation, Santa Clara, Calif. This driver is schematically illustrated in FIG. 5 and includes a plurality of comparators 56 and a resistor string 58 coupled to first inputs of the comparators; the outputs of the comparators being coupled to light emitting diodes 18. A buffer 60 has an input coupled to the signal input of network 48 and the output of the buffer is coupled to second inputs of comparators 56. A mode select amplifier 62 provides selective change to a particular type of display, whether a bar or dot display of the light emitting diodes when they are moving. Network 48 further includes an internal reference voltage source 64 which provides a voltage output across the resistance string. Each of the comparators is biased to a different comparison level or characteristic voltage by the resistance string. In the diagram of FIG. 5, for example, the reference voltage is 1.2 volts. Thus, for each 125 mV that an input signal to buffer 60 increases, a comparator will switch on a light emitting diode. Thus, the waveforms and frequencies of the input signals to network 48 determine the particular way in which the light emitting diode are switched on and off to provide various light designs.

Oscillators 50 and 52 are coupled to the input terminal of network 48 as shown in FIG. 4. To this end, each oscillator comprises a C MOS Schmitt Trigger 66 whose input is coupled to a capacitor 68 to ground and a variable resistor 70 across the Schmitt Trigger. A lead 72 from oscillator 50 is coupled to the input terminal 74 of network 48. The output of oscillator 52 is coupled by a switch 76 and a lead 78 to a voltage divider 80 and then to lead 72 by a lead 82.

A lead 84 coupled with lead 72 is coupled to the input of a two-transistor audio amplifier 86 whose output is directed to a speaker 88 through a capacitor 90. Thus, the output of oscillators 50 and 52 or oscillator 50 by itself can be transformed into sound using speaker 88 and the sound will correspond to the operation of light emitting diodes 18. Waveshaping can be accomplished by using a resistor 92 and capacitors 94 and 96 coupled by switches 98 to lead 84. Thus, a square wave output from one or both oscillators can be changed to a sawtooth wave output by switching in one or both capacitors 94 and 96.

Figure 3:
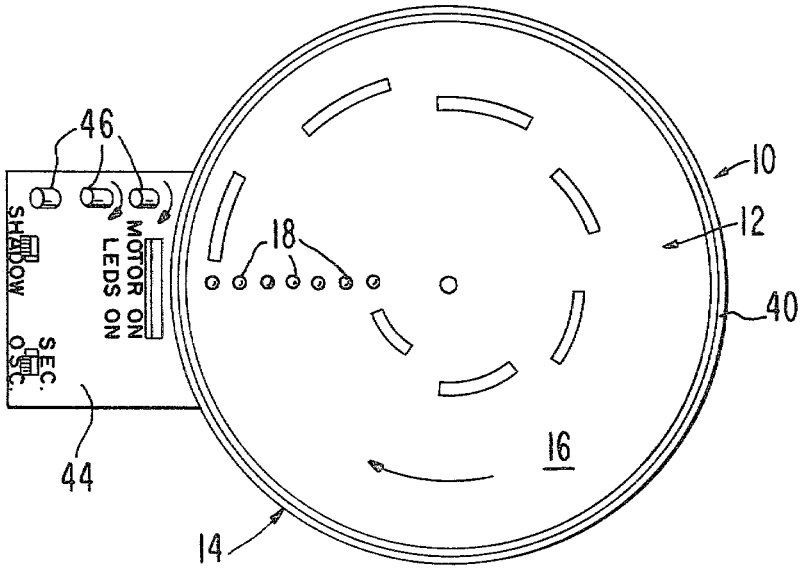
FIG. 3 is a top plan view of the apparatus, showing schematically a number of bar patterns which are observable at different circumferential locations on the rotor as the light emitting diodes are rotated and as the diodes are operated by the control circuit.

To provide bar or dot effects when operating light emitting diodes 18, a single pole, double throw switch 100 is coupled to network 48 and to a voltage source. Thus, in one position of switch 100, the effect is to provide dots (FIG. 6 shows a star pattern formed from dots of light) and in the other position of the switch, the effect is to provide bars of light (FIG. 3).

A microphone input to network 48 will permit input sounds to control the actuation of diodes 18. A microphone 110 is coupled to the input of a two-transistor amplifier 112 as shown in FIG. 4. The output of the amplifier is coupled through a switch 114 to pin 5 or the signal input of network 48. Thus, the microphone and its amplifier become the signal generating means usable in lieu of the oscillators.

In operation, using only oscillator 50, i.e., with switch 76 open, the output of the oscillator is a square wave which, when applied to the input terminal of driver 49 will energize those light emitting diodes 18 whose characteristic voltages are equal to or above the peak output voltage of oscillator 50. This square wave peak output voltage can be changed by switching in resistor 92 in which case a greater load will be placed on the output of the oscillator 50, thereby reducing the peak output voltage applied to the input terminal of network 48. Thus, if this reduced peak output voltage is less than the characteristic voltages of some of the light emitting diodes, these diodes will not be energized while the remaining diodes will be energized. By switching in one or both of capacitors 94 and 96, the square wave output can be changed to a generally sawtooth output. This will provide a sequential operation of the light emitting diode since the voltage will progressively rise to a peak and then decrease. In this way, the star-shaped design, such as that shown in FIG. 6, can be generated. The output of oscillator 50 also drives amplifier 86 and speaker 88 so that the on/off operation of diodes 18 also provides a corresponding sound output from the speaker.

By closing switch 76, second oscillator 52 is placed in operation and its output is a square wave also. Its output voltage and frequency can be higher or lower than that of oscillator 50. The voltage of the output signal of oscillator 52 can be varied by its resistor 70 and by voltage divider 80.

With apparatus 10, it is possible to obtain many different patterns and shapes of light designs. This can be achieved by modulating any number of the light emitting diodes at different frequencies. Thus, the present invention provides for the use of any switching system that can control the light emitting diodes in sequence or randomly. This can also be achieved by the use of a microprocessor which is programmed to turn the diodes on and off at specific frequencies and in certain sequences to provide light patterns of different type. By using a microprocessor, games such as "PONG" and "BREAKOUT" can be programmed into apparatus 10 using the light design display much like a television screen.

I claim:

1. A light design apparatus comprising: a plurality of light emitting diodes; means mounting the diodes for movement along generally continuous paths with the paths being adjacent to each other; means coupled with each of the diodes, respectively, for providing a characteristic operating voltage for the diode; means coupled with said providing means for generating an input signal; and switch means coupled with the providing means of each diode, respectively, for applying the input signal to said diodes in a sequence and at a frequency as a function of the characteristic operating voltages of the diodes and as the diodes move along said paths.

2. Apparatus as set forth in claim 1, wherein said mounting means includes a rotor, and means mounting the rotor for rotation about a central axis, the light emitting diodes being carried by the rotor.

3. Apparatus as set forth in claim 2, wherein the rotor has a flat outer surface, the diodes being adjacent to the surface along a line substantially radial to the central axis of the rotor.

4. Apparatus as set forth in claim 2, wherein is included a base, said rotor being mounted on said base, the base having a hollow interior, said providing means and said signal generating means being in the interior of the base, and contact means coupled with the rotor for electrically coupling the diodes with said providing means to permit rotation of the diodes as the base remains stationary.

5. Apparatus as set forth in claim 1, wherein said switch means includes a comparator for each diode, respectively, said providing means including a reference voltage source, and a voltage divider across said voltage source and coupled to the comparators to provide said characteristics voltage for each diode, respectively, and means coupling the signal generating means to each comparator.

6. Apparatus as set forth in claim 5, wherein said voltage divider comprises a plurality of resistors in series to present a resistance string, each resistor having one end thereof coupled to a respective comparator, the resistance string being connected across said reference voltage source.

7. Apparatus as set forth in claim 1, wherein said signal generating means comprises an electronic oscillator having means for varying the frequency of the output signal thereof.

8. Apparatus as set forth in claim 7, wherein is included means for varying the waveform of the output signal of the oscillator.

9. Apparatus as set forth in claim 8, wherein said varying means includes a capacitor.

10. Apparatus as set forth in claim 8, wherein said varying means includes a resistor and a capacitor in parallel with each other.

11. Apparatus as set forth in claim 7, wherein is included an audio amplifier having an input coupled to the output of the oscillator, and a speaker coupled to the output of the audio amplifier.

12. Apparatus as set forth in claim 1, wherein said providing means includes means for changing the operating times of the diodes to provide a dot or bar lighting effect as the diodes move along said paths.

13. A method of providing light designs of different shapes and patterns comprising: moving a number of light emitting diodes along generally continuous paths with the paths being adjacent to each other; providing each diode, respectively, with a characteristic voltage at which it is actuated; providing an input signal having a waveform and frequency; comparing the input signal voltage with the characteristic voltages of the diodes as said diodes move along said paths; and actuating the diodes as a function of the comparison of the input signal and characteristic voltages, whereby the diodes will present a light design having a relationship to the waveform and frequency of the input signal.

14. A method as set forth in claim 13, wherein the waveform of the input signal is a square wave.

15. A method as set forth in claim 13, wherein the waveform of the input signal is a sawtooth wave.

16. A method as set forth in claim 13, wherein is included the step of providing a sound as a function of the actuation of the diode.

17. A method as set forth in claim 13, wherein is included the step of actuating the diodes in a manner such that they define light dots along said paths.

18. A method as set forth in claim 13, wherein is included the step of actuating the diodes in a manner such that they define light bars along said paths.

19. A method as set forth in claim 13, wherein said moving step includes rotating the diodes about a central axis.

20. A method as set forth in claim 13, wherein is included the step of shaping the waveform of the input signal before it is compared with the characteristic voltages.

21. A light design apparatus comprising: a plurality of light emitting diodes; means mounting the diodes for movement along generally continuous paths with the paths being adjacent to each other; means coupled with the diodes for forming an actuatable switching network therefor with said network being operable to actuate the diodes responsive to the voltage levels of an input signal; means coupled with said network for generating an input signal; and means coupled with said generating means for applying the input signal to said network and for actuating the network and thereby the diodes as a function of the voltage levels of the input signal.

* * * * *